US006586865B1

(12) United States Patent
Tamai

(10) Patent No.: US 6,586,865 B1
(45) Date of Patent: Jul. 1, 2003

(54) VARIABLE GAP SPARK PLUG

(75) Inventor: Goro Tamai, Sterling Heights, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/569,204

(22) Filed: May 11, 2000

(51) Int. Cl.[7] ..... H01T 13/20
(52) U.S. Cl. ..... 313/141; 313/125; 313/144
(58) Field of Search ..... 313/141, 142, 313/125, 135, 136, 144

(56) References Cited

U.S. PATENT DOCUMENTS

| | | | | | |
|---|---|---|---|---|---|
| 4,331,899 | A | * | 5/1982 | Nishida et al. | 313/141 |
| 4,465,952 | A | * | 8/1984 | Sato et al. | 313/136 |
| 4,514,657 | A | | 4/1985 | Igashira et al. | 313/130 |
| 4,700,103 | A | * | 10/1987 | Yamaguchi et al. | 313/141 |
| 4,743,793 | A | * | 5/1988 | Toya et al. | 313/141 |
| 4,906,889 | A | * | 3/1990 | Dibert | 313/126 |
| 5,463,267 | A | * | 10/1995 | Conway | 313/141 |
| 5,465,022 | A | * | 11/1995 | Katoh et al. | 313/144 |
| 5,574,329 | A | * | 11/1996 | Kagawa | 313/141 |
| 5,675,209 | A | * | 10/1997 | Hall, Jr. et al. | 313/141 |
| 5,856,724 | A | | 1/1999 | Chiu et al. | 313/141 |
| 5,894,186 | A | * | 4/1999 | Matsutani et al. | 313/141 |
| 5,977,695 | A | * | 11/1999 | Osamura et al. | 313/141 |
| 6,307,307 | B1 | * | 10/2001 | Kanao | 313/142 |

* cited by examiner

*Primary Examiner*—Vip Patel
*Assistant Examiner*—Kevin Quarterman
(74) *Attorney, Agent, or Firm*—Vincent A. Cichosz

(57) ABSTRACT

A spark plug for igniting an air/fuel mixture in a combustion chamber of an internal combustion engine includes a spark gap having a variable distance defined between a central electrode and a ground electrode portion of a ground terminal. The ground terminal is formed using either a bimetallic layer arrangement wherein one of the metallic materials has a different coefficient of thermal expansion than the other metallic material, or is formed using a strut or by thickening the metal where the ground terminal is connected to a metal housing of the spark plug. The ground terminal deflects away from the central electrode when subjected to an increased temperature, such as may occur when the engine warms up during operation.

7 Claims, 2 Drawing Sheets

VARIABLE GAP SPARK PLUG

BACKGROUND OF THE INVENTION

1. Technical Field

The present invention relates generally to a spark plug of the type used in an electric spark ignition system of an internal combustion engine, and, more particularly, to a variable gap spark plug.

2. Discussion of the Related Art

Spark ignition of an internal combustion engine generally involves igniting a mixture of air and fuel with an electric discharge ("spark"). FIG. 1 illustrates a conventional spark plug 10 having a housing 12 configured to retain an insulator body 14. Plug 10 includes a central terminal 16 comprising a central electrode 18, and a ground terminal 20 comprising a ground electrode 22. The space between an end surface 24 of central electrode 18 and ground electrode 22 defines a gap 26. The spark occurs across gap 26. The distance of gap 26 of plug 10 is fixed. One shortcoming of a fixed gap distance is that it is a compromise between startability of a cold engine, which improves as the distance is reduced (up to some predetermined minimum gap), and a dilution tolerance (air or EGR) of a warm engine, which improves as the distance is increased due to a higher voltage elongated spark. Accordingly, neither startability nor dilution tolerance is optimized using a conventional, fixed gap spark plug.

It is known, however, to provide a spark plug having dual gaps, as seen by reference to U.S. Pat. No. 4,514,657 issued to Igashira et al. entitled "SPARK PLUG HAVING DUAL GAPS FOR INTERNAL COMBUSTION ENGINES." Igashira et al. disclose a central electrode, an earth electrode and a supplementary electrode provided on the earth electrode or the tip end of the central electrode. The supplementary electrode cooperates with one of the other electrodes to form a spark gap which is smaller in dimension than the normal spark gap defined between the earth and central electrodes. Igashira et al. disclose that the small gap is used at the beginning of the discharge to enable a reduction in the discharge voltage demand. Neither gap is disclosed as being selected based on an operating temperature. This is not surprising since, at cold temperatures, the larger gap remains active, and at warmer engine operating temperatures, the reduced dimension gap remains active. It is believed that maintaining both sized spark gaps through an operating temperature range is less than optimally efficient, in terms of energy usage.

There is therefore a need to provide a spark plug that minimizes or eliminates one or more of the shortcomings as set forth above.

SUMMARY OF THE INVENTION

An advantage of the present invention is that it optimizes cold startability of an internal combustion engine by providing a first, smaller spark gap, while also optimizing warm engine operation by expanding to a larger spark gap in response to an increase in temperature.

In one embodiment according to the invention, a spark plug is provided for igniting a fuel mixture within a combustion chamber of an internal combustion engine. The plug includes a housing formed of electrically-conductive material, a central electrode having an end surface, and a ground electrode coupled to the housing. The ground electrode is disposed in a first position, at a first temperature, opposing the end surface to form a spark discharge gap therebetween, characterized in that: the ground electrode is configured to deflect away from the end surface of the central electrode to a second position in response to an increase in temperature to a second temperature. The deflection increases the spark discharge gap.

Other objects, features, and advantages of the present invention will become apparent to one skilled in the art from the following detailed description and accompanying drawings illustrating features of this invention by way of example, but not by way of limitation.

DETAILED DESCRIPTION OF THE PREFERRED EMBODIMENTS

Figure 1:
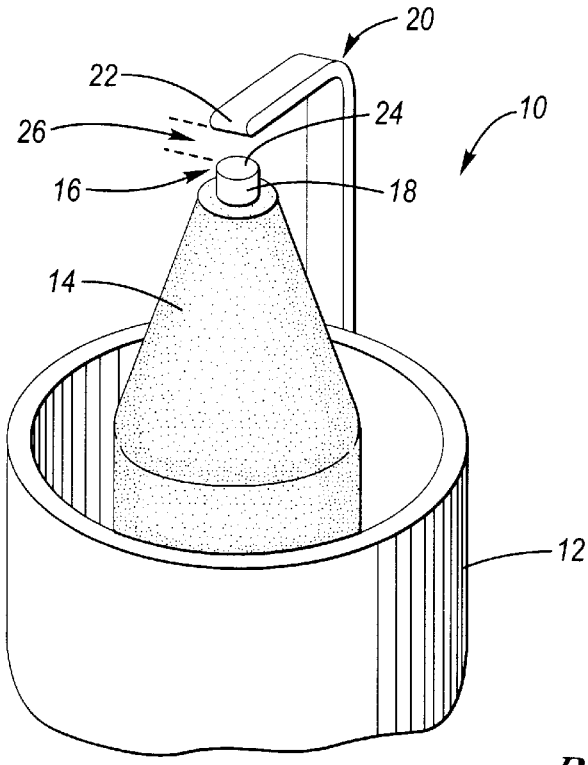
Prior Art Fig. 1
FIG. 1 is a diagrammatic, partial perspective view of a conventional spark plug.
Figure 2:
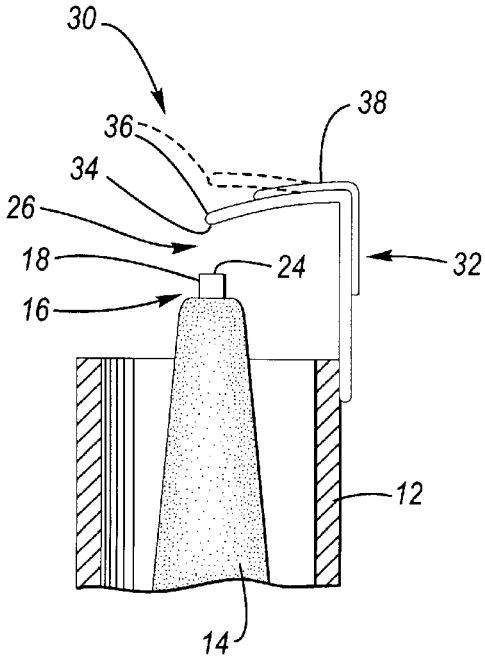
FIG. 2 is a diagrammatic, partial perspective view of a bimetallic ground electrode embodiment according to the present invention.

Referring now to the drawings wherein like reference numerals are used to identify identical components in the various views, FIG. 2 shows a spark plug 30 in accordance with the present invention. Spark plug 30 may be of generally conventional construction, in that it includes a steel housing 12 configured to retain an insulator body 14. Plug 30 further includes a central terminal 16 comprising a central electrode 18, and a ground terminal 32 comprising a ground electrode 34 on an end thereof. Insulator body 14 electrically isolates central terminal 16 from ground terminal 32. The central electrode 18 is housed in a passage in insulator body 14. The ground terminal 32 may be constructed in a generally L-shape or J-shape, and is electrically connected to housing 12, for example, by welding or the like.

The space between an end surface 24 of central electrode 18 and ground electrode 34 defines a gap 26. As is known, an ignition coil (not shown) or the like provides an ignition voltage to plug 30 to produce an electric discharge ("spark") across gap 26.

In accordance with the present invention, ground terminal 32 is configured to deflect away from end surface 24 in response to an increase in temperature. As shown in FIG. 2, ground terminal 32 assumes a first position shown in solid line format when at a first temperature. The first temperature may be a "cold" ambient starting temperature for an automotive vehicle, for example, from −40 degrees C. to 20 degrees C. The above-described deflection causes the ground terminal 32 to assume a second position (shown in dashed-line format) when at a second temperature that is greater than the first temperature. The amount of deflection to the second position is shown in an exaggerated fashion in FIG. 2. The second temperature may be a nominal operating temperature for an engine, for example, from about 300 degrees C. to 700 degrees C.

It should be appreciated that the resulting gap 26 between end surface 24 and electrode 34 increases in distance when the deflection occurs. In one embodiment, for example, the initial gap 26 at the first temperature may be a cold gap of approximately 0.040 inches, while the increased gap realized at the second temperature may be approximately equal to what a cold gap of 0.060 inches would provide.

In the embodiment illustrated in FIG. 2, terminal 32 is constructed using a bimetal arrangement comprising a first member of a first material 36 and second member of a second material 38 bonded thereto. The first material 36 is characterized by a first coefficient of thermal expansion while the second material 38 is characterized by a second coefficient of thermal expansion that is less than said first coefficient. The first material 36 may comprise material conventionally used for ground electrodes in the spark plug art, for example, to satisfy wear and conductivity standards. The second material 38 may be one selected from a group of conventional bimetallics comprising, for example, nickel, chromium, molybdenum, iron alloys and copper alloys. The particular dimensions (e.g., thickness), and materials used may be selected based on known properties for the chosen material, in conjunction with a desired amount of deflection over a contemplated temperature range, and desired electrical conductivity requirements. The initial gap 26 is selected to improve startability. The increased gap that occurs as the engine warms results in higher voltage spark, improving the engine's dilution tolerance.

Figure 3:
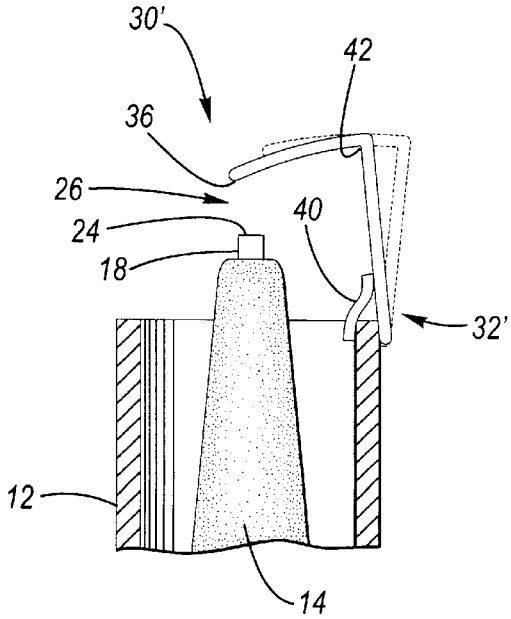
FIG. 3 is a diagrammatic, partial perspective view of a strut-based ground electrode embodiment according to the present invention which may be bimetallic.
Figure 5:
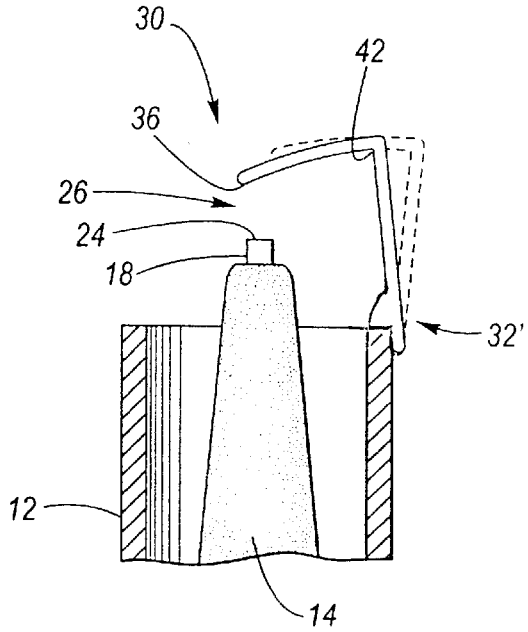
FIG. 5 is a diagrammatic, partial perspective and section view of a still further strut-based ground electrode embodiment according to the present invention.

FIG. 3 shows a second embodiment of the present invention, designated spark plug 30'. Spark plug 30' is essentially the same as plug 30, except that it includes an alternate arrangement for deflection of a ground terminal, designated 32' in FIG. 3. In particular, ground terminal 32' includes a strut member 40 or the like. Strut member 40 may comprise a material having a higher coefficient of thermal expansion than that of first member 36. Alternatively, strut 40 may comprise a thickened portion of member 36 itself on an inner side thereof where it is connected to housing 12 (FIG. 5). In either embodiment, an increase in temperature from a first temperature to a second temperature will cause the terminal 32' to deflect from a first position (shown in solid line) to the second position (shown in dashed-line). The deflection occurs because strut 40 expands more than the member 36, thereby deflecting it. The gap 26 between electrode 34 and end surface 24 will thereby increase. The specific construction of strut 40 (or the adding of material) will vary, all within the skill of one of ordinary skill in the art, based on the design criteria described above in connection with spark plug 30.

Figure 4:
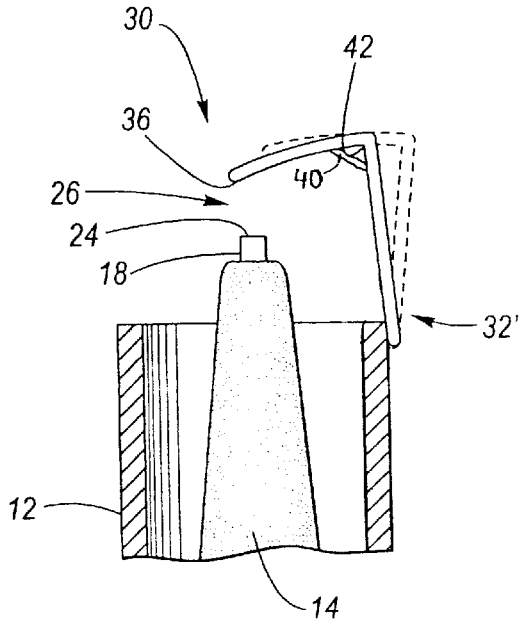
FIG. 4 is a diagrammatic, partial perspective and section view of a further strut-based ground electrode embodiment according to the present invention.

In a still further embodiment, another strut member (FIG. 4) is adhered to an inside bend portion of terminal 32', at approximately the position designated 42 in FIG. 3, in lieu of strut 40. Such other strut is characterized as having a higher coefficient of thermal expansion than member 36. Accordingly, when an increase in temperature occurs, gap 26 will increase. In a still further embodiment, shape memory alloys may be used for terminal 32'.

The variable gap of a spark plug according to the present invention is configured to change (increase) as the engine warms up, resulting in a more optimal gap for both cold starting and warm running. Particularly, for cold starting, a propensity for misfire (fouling) can be reduced to thereby provide a smoother and cleaner starting engine by selecting an appropriately small "cold gap" distance. At warmer temperatures, the wider gap generates a larger spark, thereby providing the capability to handle greater dilution rates, reducing emissions and increasing fuel economy.

In accordance with the provisions of the patent statutes, the principle and mode of operation of this invention have been explained and illustrated in several preferred embodiments. However, it must be understood that this invention may be practiced otherwise than as specifically explained and illustrated without departing from its spirit and scope.

I claim:

1. A spark plug for igniting a fuel mixture within a combustion chamber of an internal combustion engine, the plug comprising:

a housing formed of electrically-conductive material;

a central electrode having an end surface;

a ground terminal coupled to said housing having a ground electrode, the ground electrode being disposed in a first position, at a first temperature, opposing said end surface to form a gap therebetween and wherein the ground terminal is configured to deflect such that the ground electrode moves away from said end surface in response to an increase in temperature to a second temperature greater than said first temperature to thereby increase the gap, wherein the ground terminal comprises a first member having a first coefficient of thermal expansion and a second member having a second coefficient of thermal expansion different from the first coefficient of thermal expansion, said first and second member being arranged in a bimetallic arrangement configured to cause said deflection responsive to said increase in temperature.

2. The spark plug of claim 1 wherein the second member is one selected from the group consisting of nickel, chromium, molybdenum, iron alloys and copper alloys.

3. A spark plug for igniting a fuel mixture within a combustion chamber of an internal combustion engine, the plug comprising:

a housing formed of electrically-conductive material;

a central electrode having an end surface; a ground terminal coupled to said housing having a ground electrode, the ground electrode being disposed in a first position, at a first temperature, opposing said end surface to form a gap therebetween and wherein the ground terminal is configured to deflect such that the ground electrode moves away from said end surface in response to an increase in temperature to a second temperature greater than said first temperature to thereby increase the gap, wherein the ground terminal comprises a generally L-shaped member, said plug further including a strut member disposed between the housing and the L-shaped member at a location proximate to where the L-shaped member connects to the housing, said strut having a first coefficient of thermal expansion that is greater than a second coefficient of thermal expansion associated with the L-shaped member.

4. The spark plug of claim 1 wherein said first member faces said central electrode.

5. The spark plug of claim 1 wherein the second member is one selected from the group consisting of chromium and molybdenum.

6. The spark plug of claim 3 wherein said strut comprises a thickened portion of said L-shaped member on an inner side thereof.

7. A spark plug for igniting a fuel mixture within a combustion chamber of an internal combustion engine, the plug comprising:

a housing formed of electrically-conductive material;

a central electrode having an end surface; a ground terminal coupled to said housing having a ground electrode, the ground electrode being disposed in a first position, at a first temperature, opposing said end surface to form a gap therebetween and wherein the ground terminal is configured to deflect such that the ground electrode moves away from said end surface in response to an increase in temperature to a second temperature greater than said first temperature to thereby increase the gap, wherein the ground terminal comprises a generally L-shaped member, said plug further including a strut member adhered to an inside bend portion of said L-shaped member, said strut member having a first coefficient of thermal expansion that is greater than a second coefficient of thermal expansion associated with said L-shaped member.

* * * * *